US005498348A

United States Patent [19]

Plink et al.

[11] Patent Number: 5,498,348

[45] Date of Patent: Mar. 12, 1996

[54] MOBILE FLOATING SURFACE SKIMMER

[76] Inventors: Max R. Plink, 154 Fowler Road; Robbert W. Plink, 2 McCriedy, both of Guildford, New South Wales, Australia, 2161; Dennis Plink, 27 Inconstant Street, Blackheath, New South Wales, Australia, 2785

[21] Appl. No.: 211,688

[22] PCT Filed: Oct. 13, 1992

[86] PCT No.: PCT/AU92/00544

§ 371 Date: Apr. 13, 1994

§ 102(e) Date: Apr. 13, 1994

[87] PCT Pub. No.: WO93/08351

PCT Pub. Date: Apr. 29, 1993

[30] Foreign Application Priority Data

Oct. 14, 1991 [AU] Australia ..... PK8850

[51] Int. Cl.[6] ..... E02B 15/04

[52] U.S. Cl. ..... 210/776; 210/122; 210/127; 210/242.1; 210/242.3; 210/923

[58] Field of Search ..... 210/242.1, 242.3, 210/776, 923, 122, 123, 127

[56] References Cited

U.S. PATENT DOCUMENTS

| | | | |
|---|---|---|---|
| 3,970,556 | 7/1976 | Gore | 210/242.3 |
| 4,024,063 | 5/1977 | Mori | 210/923 |
| 4,105,557 | 8/1978 | Weatherholt | 210/242.1 |
| 4,243,529 | 1/1981 | Strauss | 210/242.1 |
| 4,325,150 | 4/1982 | Buddy | 210/242.1 |
| 4,405,458 | 9/1983 | McHugh, Jr. | 210/242.1 |
| 4,746,424 | 5/1988 | Drew | 210/242.1 |
| 4,802,592 | 2/1989 | Wessels | 210/242.1 |
| 4,879,026 | 11/1989 | Metais | 210/242.1 |
| 4,906,366 | 3/1990 | Moore | 210/242.3 |
| 4,908,127 | 3/1990 | Metais | 210/242.3 |
| 5,043,065 | 8/1991 | Propp | 210/242.3 |
| 5,078,863 | 1/1992 | Durigon | 210/242.1 |

FOREIGN PATENT DOCUMENTS

| | | |
|---|---|---|
| 0007891 | 2/1980 | European Pat. Off. . |
| 2410093 | 6/1979 | France . |
| 2478700 | 9/1981 | France . |
| 2581689 | 11/1986 | France . |
| 2435881 | 2/1975 | Germany . |
| 2721108 | 11/1978 | Germany . |
| 3011251 | 10/1980 | Germany . |

*Primary Examiner*—Christopher Upton
*Attorney, Agent, or Firm*—Merchant, Gould, Smith, Edell, Welter & Schmidt

[57] ABSTRACT

A mobile floating surface skimmer is adapted to float in a body of liquid having debris and/or contaminants at the surface. The skimmer comprises a vessel having an inlet through which liquid from the surface of the body of liquid can flow into the vessel together with the debris and/or contaminants. An outlet is adapted to be connected to a pump for removing liquid, together with the debris and/or contaminants from the vessel. Further included is a valve for controlling a flow of liquid into the vessel in response to the level of liquid in the vessel so as to maintain the inlet near the surface of the body of liquid, wherein the valve is provided with a delayed response so as to cause the skimmer to oscillate vertically in the body of liquid so the debris is prevented from becoming lodged at the inlet. Further, the invention includes a method of skimming debris from the surface of a liquid.

20 Claims, 3 Drawing Sheets

MOBILE FLOATING SURFACE SKIMMER

Figure 1:
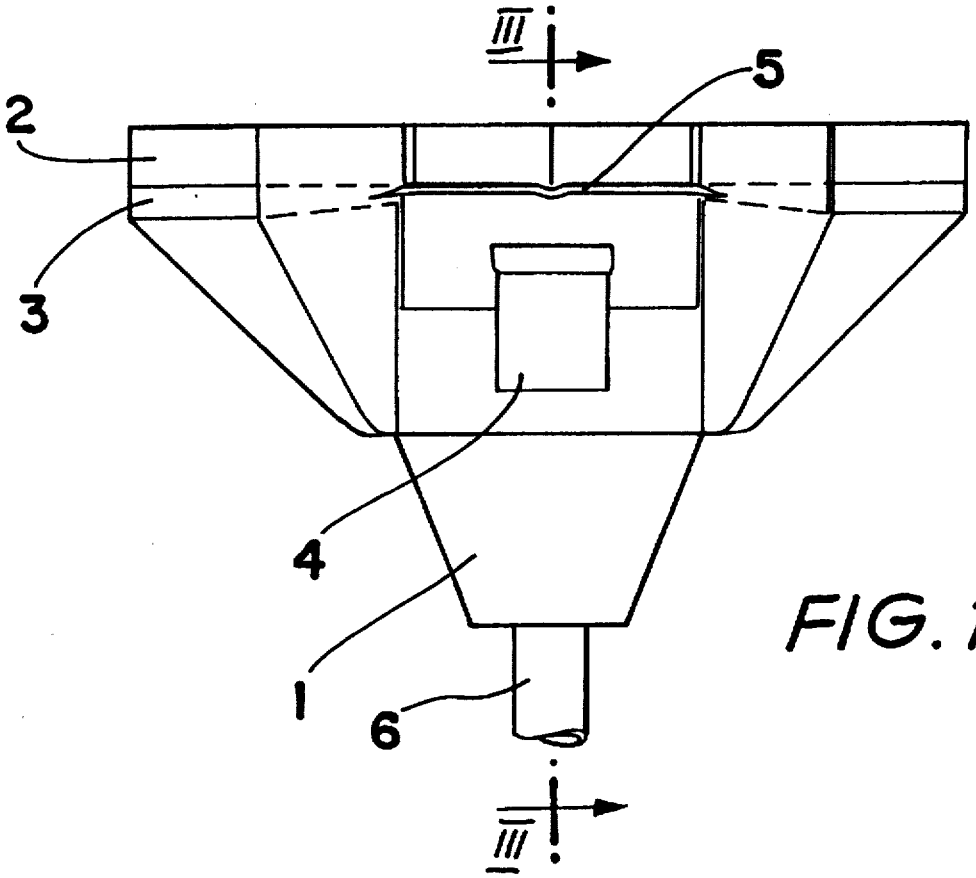

The present invention relates to surface skimmers, and in particular to a mobile floating surface skimmer which exploits the surface tension properties of liquids in order to remove a layer of liquid from the surface of a body of liquid, which may contain contaminants at or near the surface of the liquid, or which may itself be a contaminating liquid at the top of another body of liquid.

BACKGROUND ART

A floating skimmer for cleaning the surface of a body of liquid has been disclosed in U.S. Pat. No. 3,970,556 to GORE. This floating skimmer has an outer body with an inner cavity. Flotation and ballast chambers in the outer body are used to regulate the level of a flotation of a weir located within the body which regulates the flow of liquid into the met cavity from where it is pumped out via a pipe. The weir is movable and extends across the width of an inlet opening and regulates the flow of liquid into the inner cavity. The weir is pivotally hinged with a float on its underside. Therefore the weir floats on the liquid within the inner cavity and provides a cascade of liquid over the inner edge of the weir. The operation of the skimmer depends on the level of liquid within the inner cavity which varies according to the suction of the pump. The level of the liquid witch the inner cavity causes the buoyancy of the skimmer to vary during its operation and if not enough liquid from the liquid's surface cascades over the weir a loss of pulling effect can occur.

A pool skimmer for a swimming pool has been disclosed in U.S. Pat. No. 4,105,557 to WEATHERHOLT. This buoyant pool skier is powered by water pressure from a pump and is thus moved about on the surface of the water in the pool. As the skier moves about in any direction, a filter device is used to collect debris. The filter device remains within the pool during its use and therefore must be removed and cleared periodically to ensure efficient operation. The skimmer relies on the force of water passing over the filter device as it moves to collect the debris in the pool. This skier cannot be used continuously as it must be cleared regularly.

An oil collecting apparatus has been disclosed in U.S. Pat. No. 4,243,529 to STRAUSS. This apparatus has a two-part housing which defines an inner cavity and an annular opening in the side thereof. Oil is able to flow through an hydrophobic-oleophilic screen in the opening, however, water is prevented from flowing therethrough. The buoyancy of the apparatus is able to be adjusted depending on the thickness of oil. This device is inappropriate for removing debris located on the water's surface, as the pumping out system is intermittently operated by a buoyancy float.

A floating weir has been disclosed in U.S. Pat. No. 4,405,458 to McHUGH. The floating weir has a float which adjusts the level of the weir according to the internal water pressure within its floating device. The device is supposed to operate at a constant level but is able to respond to flow interceptions caused by water disturbances. This device relies on a float and if the flow interruption was greater than expected the device would not continue to operate as required.

A floating pool skimmer has been disclosed in U.S. Pat. No. 4,746,424 to DREW. This skimmer is propelled about the swimming pool whilst collecting leaves and other debris on the surface. The debris is directed downwards by water jets into a mesh bag. The device relies on the use of these water jets to clean the pool and for propulsion which requires extra piping and pumps.

Another skimmer has been disclosed in DE,A,2,435,881 to PEACOCK INVESTMENTS LTD. This skimmer includes a hollow unit, partially above the water's surface and a filter chamber between a water intake and a water outlet. The water moves through the skimmer as it moves about on the water's surface. This device has the disadvantage that it requires propulsion on the surface of the water.

OBJECT OF THE INVENTION

It is an object of the present invention to provide an improved mobile floating surface skimmer which is powered by a suction hose or equivalent and which buoyantly floats on the surface.

DISCLOSURE OF THE INVENTION

According to the present invention there is provided a mobile floating surface skimmer adapted to float in a body of liquid having debris and/or contaminants at the surface thereof, the skimmer comprising a vessel having an inlet through which liquid from the surface of the body of liquid can flow into the vessel together with said debris and/or contaminants, an outlet adapted to be connected to a pump for removing liquid, together with said debris and/or contaminants, from the vessel, and a valve for controlling a flow of liquid into the vessel in response to the level of liquid in the vessel so as to maintain the inlet near the surface of said body of liquid, wherein said valve is provided with a delayed response so as to cause the skimmer to oscillate vertically in said body of liquid so that debris is prevented from becoming lodged at the inlet.

The invention also provides a method of skimming debris from the surface of a liquid and/or skimming an upper layer of liquid, said method comprising the steps of:

1. floating a buoyant skimming device in said liquid, said device having an interior with an inlet located higher than a valve means located higher than an outlet, said valve means being for a closable opening located in the wall of said device, said inlet being located substantially near the surface of said liquid,
2. applying suction to said outlet to remove from said interior liquid which has flowed into said interior via said inlet to thereby increase the buoyancy of said device,
3. opening said valve means when the level of liquid in said interior increases to a particular level to permit said liquid to flow into said interior through both said inlet and said closable opening to thereby reduce the buoyancy of said device thus skimming the liquid's surface.
4. closing said valve means when the level of liquid in said interior increases to a predetermined level, and
5. repeating steps 3 and 4 in a delayed manner to cause the skimming device to oscillate vertically in said body of liquid so that debris is prevented from becoming lodged at the inlet.

BRIEF DESCRIPTIONS OF THE DRAWINGS

Figure 2:
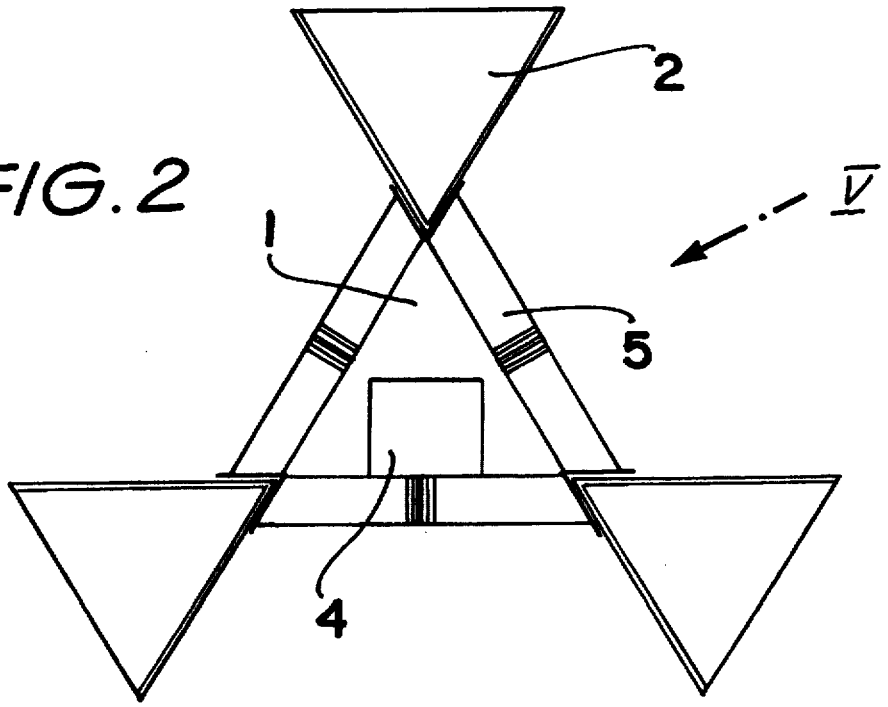
Figure 3:
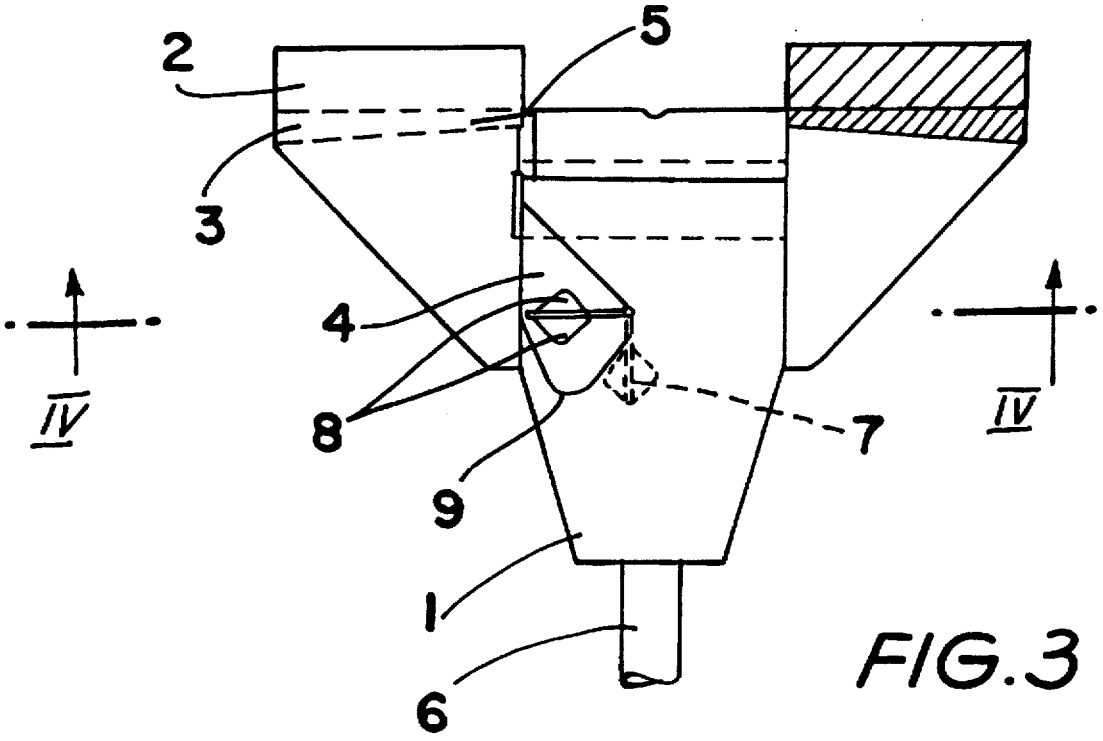
Figure 4:
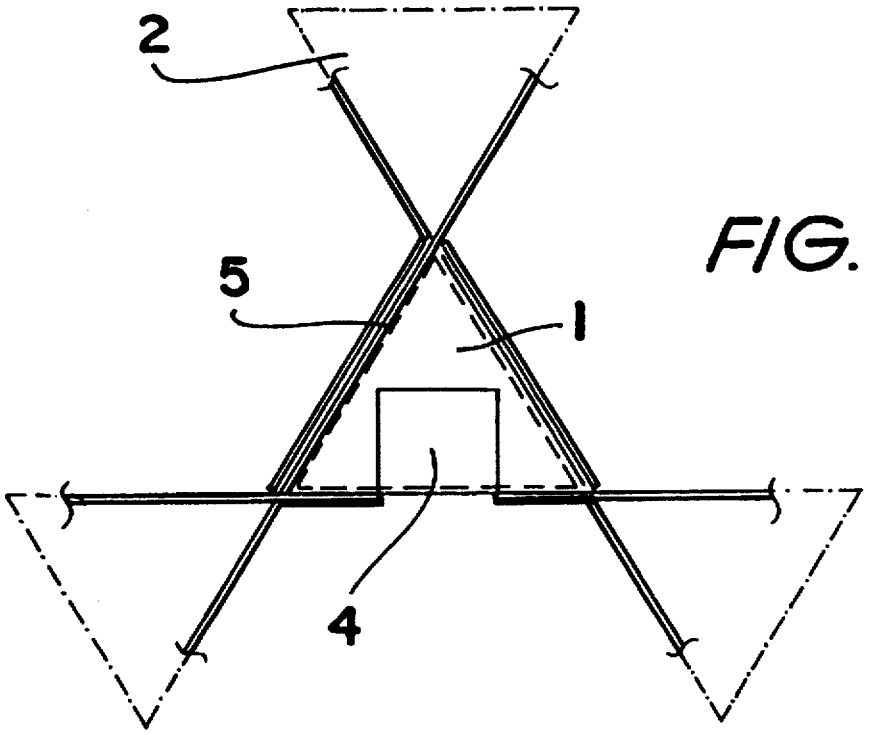
Figure 5:
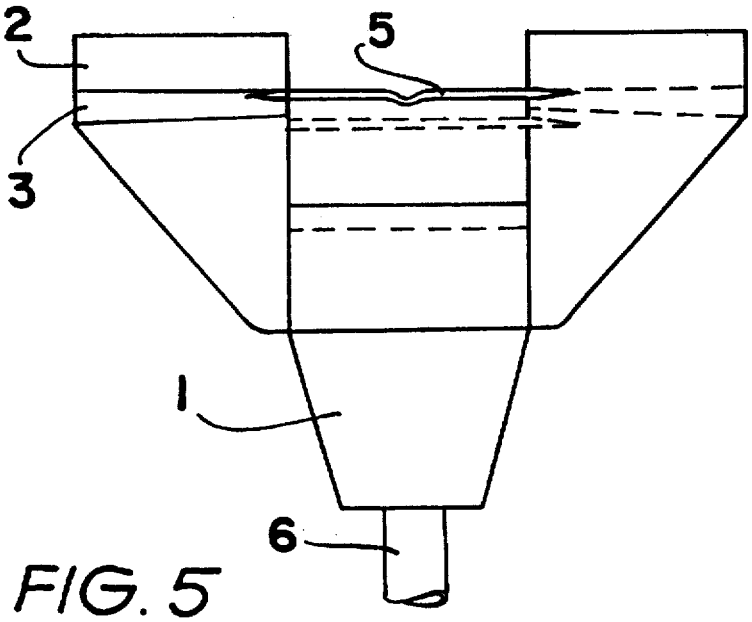
Figure 7:
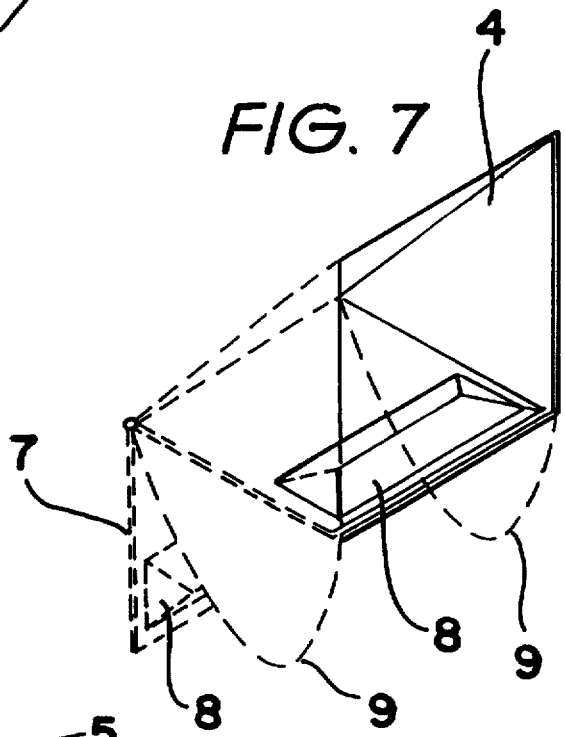
Figure 6:
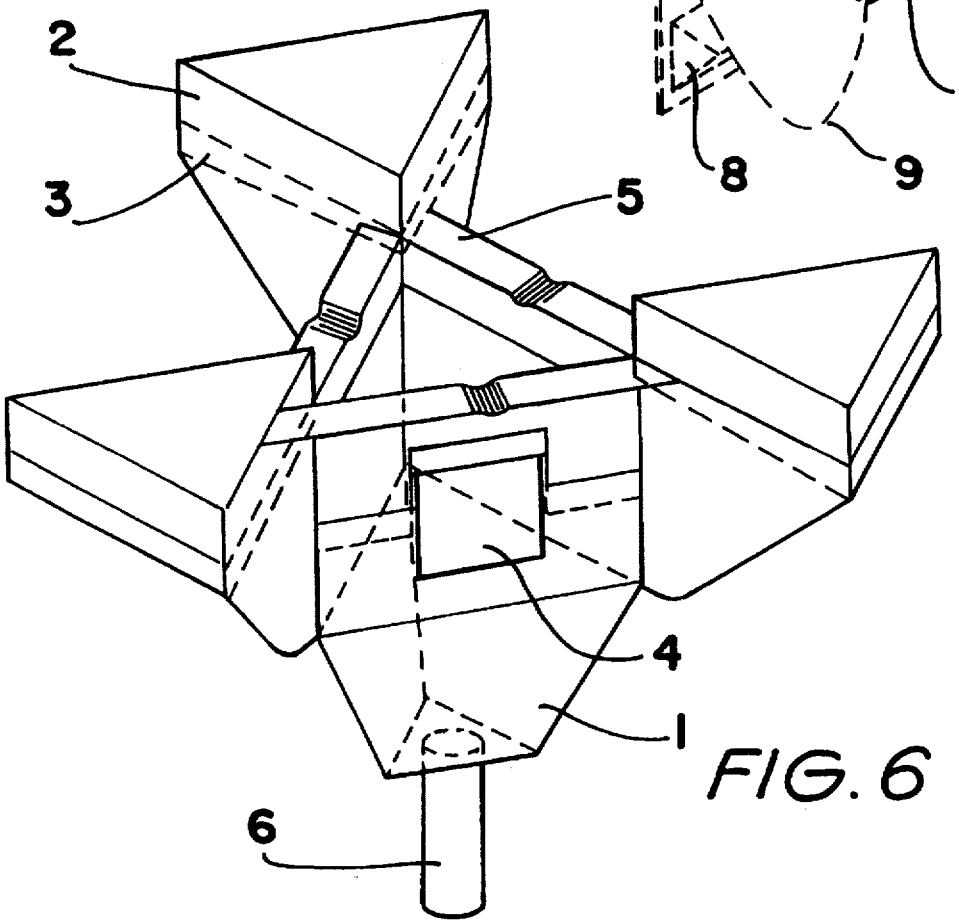

One embodiment of the present invention will now be described with reference to the drawings in which:

FIG. 1 is a side view of a mobile floating surface skimmer of a preferred embodiment, FIG. 2 is a plan view of the skimmer of FIG. 1, FIG. 3 is a cross sectional view along the lines III—III of FIG. 1, FIG. 4 is a cross sectional view along the line IV—IV of FIG. 3, FIG. 5 is a side view in the direction of the arrow V of FIG. 2, FIG. 6 is a perspective view of the skimmer of FIG. 1 showing the hidden detail in phantom, and FIG. 7 is a detailed perspective view of the pivotal valve of the skimmer of FIG. 1.

BEST MODE OF CARRYING OUT THE INVENTION

The apparatus of the preferred embodiment includes a vessel 1 into which water is drawn. The vessel 1 has a triangular transverse cross section and is tapered towards its lower end. The vessel 1 is supported in the water by three floats 2 which are triangular in cross section and are located at the comers of the vessel 1. The floats 2 have a top and bottom surface which are parallel to the surface of the water and are much broader than they are deep. The floats 2 are preferably made from water proof foam or have an air pocket located therein.

Three ballast units 3 also triangular in cross section are located directly below the floats 2. The ballast units 3 are biased towards the outside perimeter.

A valve 4 is located in a side wall of the vessel 1. A three sided weir 5 is located at the top of the vessel 1, and an outlet nozzle 6, which is connectable to an outlet hose and suction pump.(not illustrated), is fitted to the bottom of the vessel 1.

The valve 4 includes a hinged vane 7 with a buoyancy element 8. The hinged vane 7 opens and closes the valve opening 9 due to the pivoting of the vane 7.

When the apparatus is positioned in the water and at rest, the vessel 1 is preferably located below the water's surface and the floats 2 ensure that the weir 5 is positioned preferably just below the water's surface. Also when at rest, the valve 4 is closed as the buoyancy element 8 ensures that the hinged vane 7 closes the opening 9 due to the upwards pressure of the water within the vessel 1 on the buoyancy element 8.

When suction is applied to the outlet nozzle 6, the water within the vessel 1 is sucked out through the outlet nozzle 6 and therefore water on the surface of the water is drawn over the weir 5 into the vessel 1. As the floats 2 and ballast 3 are designed for a skimming operation of the apparatus, only a small amount of water is drawn over the weir 5 thus also removing any debris located on the water's surface. The weir 5 can be shaped and adjustable in height to provide a waterfall effect for the water entering the vessel 1.

As the suction through the outlet nozzle 6 lowers the water level within the vessel 1, the vessel tends to become more buoyant and therefore rises within the water. In the preferable operation of the device before the weir 5 is forced upwardly out of the water, the pressure differential between the water on the outside of the vessel 1 and within the vessel 1 opens the valve 4 by forcing the pivotal vane 7 open. It is possible for the weir 5 to break the surface of the water and rise above the water. This allows water to flow through the valve opening 9 into the vessel 1 thus rectifying the level and pressure differential. As the differential is rectified, the valve 4 then once again closes and the vessel 1 changes direction and begins to travel in a downward direction. The ballast 3 provides inertia to the apparatus in ensuring that there is a pressure differential between the water externally and internally of the vessel 1 and to provide an inertia in the downward stroke which maintains the apparatus in the downward stroke, even after the valve 4 has rectified the level and pressure differential. The floats 2 as well as keeping the apparatus afloat assist in the halting of the downward stroke.

The characteristics of the halt of the downward stroke are determined by the ratio of the buoyancy of the float to the weight of the overall apparatus, at the lowest point of the downward stroke. At the end of the downward stroke, the difference between the mass of the apparatus and its contents, and the mass of the water displaced by the apparatus, is less than at the end of its upward stroke.

The valve opening 9 in the preferred embodiment is designed in such a way that there is a delayed response in the ingress of water into the vessel 1 via the opening 9, thereby increasing the oscillatory tendency of the apparatus. The weir 5 is vertically adjustable so that the flow of water into the vessel 1 in volume is less than that being drawn from the vessel 1 through the outlet nozzle 6. The height of the weir 5 is adjustable to allow for various water densities (as are encountered in salt water pools) and pump strengths.

It has been found that the vessel 1 into which the water is drawn should preferably be tapered at the lower end onto which the outlet nozzle 6 is fitted. The immediate approach to the outlet nozzle preferably should be as smooth as possible to avoid snags and blockages.

It has also been found that the pulsating motion of the apparatus aids in the delodging of debris which may otherwise become banked up against the weir 5. Further, at one point in each cycle there is preferably a minimum depth of water being drawn from the water's surface into the vessel 1, therefore, enlarging to a maximum extent the skimmer's sphere of influence with the effect of drawing in debris from farther than would otherwise be the case.

The foregoing describes only one embodiment of the present invention and, modifications obvious to those skilled in the art can be made thereto without departing from the scope of the present invention.

For example, the apparatus can include more than one pressure sensitive valve 4 which can be incorporated into the vessel 1. The valve can be any type of pressure sensitive valve to operate the apparatus in a similar manner.

The valve 4 can be remotely controlled using an actuator to operate a valve mechanism. The weir 5 can also be adjusted by remote control of an actuator which adjusts the height and angle of the weir 5.

The water or liquid which is inlet into the vessel 1 via the valve 4 can be supplied from a remote source of water or liquid, and not necessarily from the body of water in which the apparatus is operating.

The apparatus has been described in use in water, however, the apparatus can be used in any liquid in which the top layer or layers are required to be skimmed thereoff.

We claim:

1. A mobile floating surface skimmer for floating in a body of liquid having debris and/or contaminants at the surface therefore, the skimmer comprising a vessel having an inlet through which liquid from the surface of the body of liquid can flow into the vessel together with said debris and/or contaminants, an outlet for connection to a pump for removing liquid, together with said debris and/or contaminants, from the vessel, and a valve for controlling a flow of liquid into the vessel in response to the level of liquid in the vessel, and also in response to external pressure on the valve, tending to close the valve, due to the body of liquid outside of said vessel, so as to maintain the inlet near the surface of said body of liquid, wherein said valve is provided with buoyancy means located within said vessel, which, when acted on by liquid within the vessel, produces a buoyancy force which tends to close said valve, the buoyancy force being dependent on the level of liquid in the vessel, and wherein, in use when the outlet is connected to said pump, variations in said buoyancy force, together with variations in said external pressure, cause said valve to open and close in a delayed manner so as to cause the skimmer to oscillate vertically in said body of liquid so that debris is prevented from becoming lodged at the inlet.

2. The skimmer as claimed in claim 1, wherein said valve includes a pivotable vane with a buoyancy element incorporated thereon.

3. The skimmer as cited in claim 2, wherein the inlet is adjacent the top of said vessel and includes a weir means.

4. The skimmer as claimed in claim 2 wherein said vessel has a triangular transverse cross section and the inlet is also triangular.

5. The skimmer as claimed in claim 4, which further comprises buoyancy means including three floats which are each positioned adjacent the corners of the inlet.

6. The skimmer as claimed in claim 1, wherein the inlet is adjacent the top of said vessel and includes a weir means.

7. The skimmer as claimed in claim 6, wherein said weir means is adjustable in height relative to the surface of said liquid and provides a waterfall effect for water entering said vessel.

8. The skimmer as claimed in claim 7 wherein said vessel has a triangular transverse cross section and the inlet is also triangular.

9. The skimmer as claimed in claim 8, which further comprises buoyancy means including three floats which are each positioned adjacent the corners of the inlet.

10. The skimmer as claimed in claim 6 wherein said vessel has a triangular transverse cross section and the inlet is also triangular.

11. The skimmer as claimed in claim 10, which further comprises buoyancy means including three floats which are each positioned adjacent the corners of the inlet.

12. The skimmer is claimed in claim 1, wherein said vessel has a triangular transverse cross-section and the inlet is also triangular.

13. The skimmer as claimed in claim 12, which further comprises additional buoyancy means including three floats which are each positioned adjacent the corners of the inlet.

14. The skimmer as claimed in claim 13, which further comprises ballast means including three ballast elements which are each positioned below a corresponding one of said floats.

15. The skimmer as claimed in claim 14, wherein said floats abut against the corresponding ballast elements.

16. The skimmer as claimed in claim 14, further comprises means for maintaining the inlet of said vessel below the surface of said body of liquid.

17. A method of skimming debris from the surface of a liquid and/or skimming an upper layer of liquid, said method comprising the steps of:

1. floating a buoyant skimming device in said liquid, said device comprising a vessel having an interior with an inlet located higher than a valve means located higher than an outlet, said valve means being for a closable opening located in the wall of said device, said inlet being located substantially near the surface of said liquid, said valve means being provided with buoyancy means located within said vessel, which, when acted on by liquid within the vessel, produces a buoyancy force which tends to close said valve, and said valve also being acted on by the external pressure of liquid outside the vessel which tends to open said valve;
2. applying suction to said outlet to remove from said interior liquid which has flowed into said interior via said inlet to thereby increase the buoyancy of said device;
3. opening said valve means, in response to a decrease in said buoyancy force, when the level of liquid in said interior decreases to a particular level to permit said liquid to flow into said interior through both said inlet and said closable opening to thereby reduce the buoyancy of said device thus skimming the liquid's surface;
4. closing said valve means, in response to an increase in said buoyancy force, when the level of liquid in said interior increases to a predetermined level; and
5. repeating steps 3 and 4, with an appropriate time delay between each step due to the time taken for the necessary changes in said buoyancy force to occur, to cause the skimming device to oscillate vertically in said body of liquid so that debris is prevented from becoming lodged at the inlet.

18. The method as claimed in claim 12, wherein the inlet is maintained below the surface of the liquid.

19. A mobile floating surface skimmer for floating in a body of liquid having debris and/or contaminants at the surface therefore, the skimmer comprising a vessel having an inlet through which liquid from the surface of the body of liquid can flow into the vessel together with said debris and/or contaminants, an outlet for connection to a pump for removing liquid, together with said debris and/or contaminants, from the vessel, a valve for controlling a flow of liquid into the vessel in response to the level of liquid in the vessel so as to maintain the inlet near the surface of said body of liquid, and delay means for delaying opening and closing of the valve in use when the outlet is connected to said pump so as to cause the skimmer to oscillate vertically in said body of liquid so that debris is prevented from becoming lodged at the inlet.

20. The skimmer as claimed in claim 19, wherein the delay means comprises buoyancy means, coupled to the valve and located within said vessel, for producing a buoyancy force which tends to close said valve, the buoyancy force being dependent on the level of liquid in the vessel.

* * * * *

UNITED STATES PATENT AND TRADEMARK OFFICE
CERTIFICATE OF CORRECTION

PATENT NO. : 5,498,348

DATED : March 12, 1996

INVENTOR(S) : Plink et al.

It is certified that error appears in the above-identified patent and that said Letters Patent is hereby corrected as shown below:

Column 2, line 18, "met" should read --inner--.

Column 1, line 25, "witch" should read --within-

Column 1, lines 32, 34, 39, "skier" should read --skimmer--.

Column 3, line 20, "comers" should read --corners--.

Signed and Sealed this

Fifteenth Day of October, 1996

*Attest:*

Bruce Lehman

BRUCE LEHMAN

*Attesting Officer*

*Commissioner of Patents and Trademarks*